US011120814B2

(12) United States Patent
Li

(10) Patent No.: US 11,120,814 B2
(45) Date of Patent: Sep. 14, 2021

(54) MULTI-MICROPHONE SIGNAL ENHANCEMENT

(71) Applicant: Dolby Laboratories Licensing Corporation, San Francisco, CA (US)

(72) Inventor: Chunjian Li, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 596 days.

(21) Appl. No.: 15/999,484

(22) PCT Filed: Feb. 16, 2017

(86) PCT No.: PCT/US2017/018234

§ 371 (c)(1),
(2) Date: Aug. 20, 2018

(87) PCT Pub. No.: WO2017/143105

PCT Pub. Date: Aug. 24, 2017

(65) Prior Publication Data

US 2021/0210111 A1 Jul. 8, 2021

Related U.S. Application Data

(60) Provisional application No. 62/309,380, filed on Mar. 16, 2016.

(30) Foreign Application Priority Data

Feb. 19, 2016 (WO) ..... PCT/CN2016/074102
Mar. 23, 2016 (EP) ..... 16161826

(51) Int. Cl.

| | |
|---|---|
| ***G10L 21/0208*** | (2013.01) |
| ***H04R 3/00*** | (2006.01) |
| *G10L 21/0216* | (2013.01) |

(52) U.S. Cl.

CPC ..... *G10L 21/0208* (2013.01); *H04R 3/005* (2013.01); *G10L 2021/02166* (2013.01); *H04R 2201/40* (2013.01); *H04R 2410/07* (2013.01)

(58) Field of Classification Search

None

See application file for complete search history.

(56) References Cited

U.S. PATENT DOCUMENTS

| | | | |
|---|---|---|---|
| 5,917,921 | A | 6/1999 | Sasaki |
| 7,881,480 | B2 | 2/2011 | Buck |

(Continued)

FOREIGN PATENT DOCUMENTS

| | | |
|---|---|---|
| JP | 5663112 | 2/2015 |
| WO | 2003/009639 | 1/2003 |
| WO | 2015/179914 | 12/2015 |

OTHER PUBLICATIONS

Walker, K.T. "Methods for determining infrasound phase velocity direction with an array of line sensors", Jul. 2008, J Acoust Soc Am., pp. 2090-2099.

(Continued)

*Primary Examiner* — Paul W Huber

(57) ABSTRACT

Microphone signals are received from microphones of a computer device. Each microphone signal of the microphone signals is acquired by a respective microphone of the microphones. A previously unselected microphone is selected from the microphones as a reference microphone, which generates a reference microphone signal. An adaptive filter is used to create, based on microphone signals of the microphones other than the reference microphone, predicted microphone signals for the reference microphone. Based on the predicted microphone signals for the reference microphone, an enhanced microphone signal is outputted for the reference microphone. The enhanced microphone signal (Continued)

may be used as microphone signal for the reference microphone in subsequent audio processing operations.

15 Claims, 9 Drawing Sheets

(56) References Cited

U.S. PATENT DOCUMENTS

| | | | | |
|---|---|---|---|---|
| 8,098,844 | B2 | 1/2012 | Elko | |
| 8,155,927 | B2 | 4/2012 | Taenzer | |
| 8,238,575 | B2 | 8/2012 | Buck | |
| 8,249,862 | B1 | 8/2012 | Cheng | |
| 8,712,076 | B2 | 4/2014 | Dickins | |
| 8,724,829 | B2 | 5/2014 | Visser | |
| 8,861,745 | B2 | 10/2014 | Yen | |
| 8,913,758 | B2 | 12/2014 | Levi | |
| 8,942,387 | B2 | 1/2015 | Elko | |
| 9,202,475 | B2 | 12/2015 | Elko | |
| 9,641,935 | B1 * | 5/2017 | Ivanov | H04R 3/005 |
| 2006/0013412 | A1 | 1/2006 | Goldin | |
| 2008/0317261 | A1 | 12/2008 | Yoshida | |
| 2009/0190774 | A1 | 7/2009 | Wang | |
| 2010/0246851 | A1 * | 9/2010 | Buck | G10L 21/0208 381/94.1 |
| 2012/0121100 | A1 | 5/2012 | Zhang et al. | |
| 2012/0128163 | A1 | 5/2012 | Moerkebjerg | |
| 2013/0191119 | A1 | 7/2013 | Sugiyama | |
| 2013/0195276 | A1 | 8/2013 | Ojala | |
| 2013/0308784 | A1 | 11/2013 | Dickins | |
| 2015/0264478 | A1 | 9/2015 | Aubreville | |
| 2016/0012828 | A1 | 1/2016 | Chatlani | |
| 2016/0071508 | A1 * | 3/2016 | Wurm | G10K 11/17854 381/58 |

OTHER PUBLICATIONS

Thiemann1, J. et al. "Speech enhancement for multimicrophone binaural hearing aids aiming to preserve the spatial auditory scene", Feb. 2016 EURASIP Journal on Advances in Signal Processing 2016, 2016:12.

Jazi, N. et al. "Dual-Microphone and Binaural Noise Reduction Techniques for Improved Speech Intelligibility by Hearing Aid Users", 2013, ProQuest, ISBN 9781303167775 University/institution The University of Texas at Dallas.

Marquardt, D. et al. "Coherence preservation in multi-channel Wiener filtering based noise reduction for binaural hearing aids",May 26-31, 2013 IEEE International Conference on Acoustics, Speech and Signal Processing, pp. 8648-8652.

* cited by examiner

MULTI-MICROPHONE SIGNAL ENHANCEMENT

TECHNOLOGY

Example embodiments disclosed herein relate generally to processing audio data, and more specifically to multi-microphone signal enhancement.

BACKGROUND

A computer device such as a mobile device may operate in a variety of environments such as sports events, school events, parties, concerts, parks, and the like. Thus, microphone signal acquisition by a microphone of the computer device can be exposed or subjected to multitudes of microphone-specific and microphone-independent noises and noise types that exist in these environments.

Multiple microphones are commonly found in a computing device nowadays. For a computer device that is equipped with specific audio processing capabilities, the computer device may use multiple original microphone signals acquired by multiple microphones to generate an audio signal that contains less noise content than the original microphone signals. However, the noise-reduced audio signal typically has different time-dependent magnitudes and time-dependent phases as compared with those in the original signal signals. Spatial information captured in the original microphone signals, which for example could indicate where sound sources are located, can be tempered, shifted or lost in the audio processing that generates the noise-reduced audio signal.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The example embodiments illustrated by way of example, and not by way of limitation, in the figures of the accompanying drawings and in which like reference numerals refer to similar elements and in which.

DESCRIPTION OF EXAMPLE EMBODIMENTS

Figure 1A:
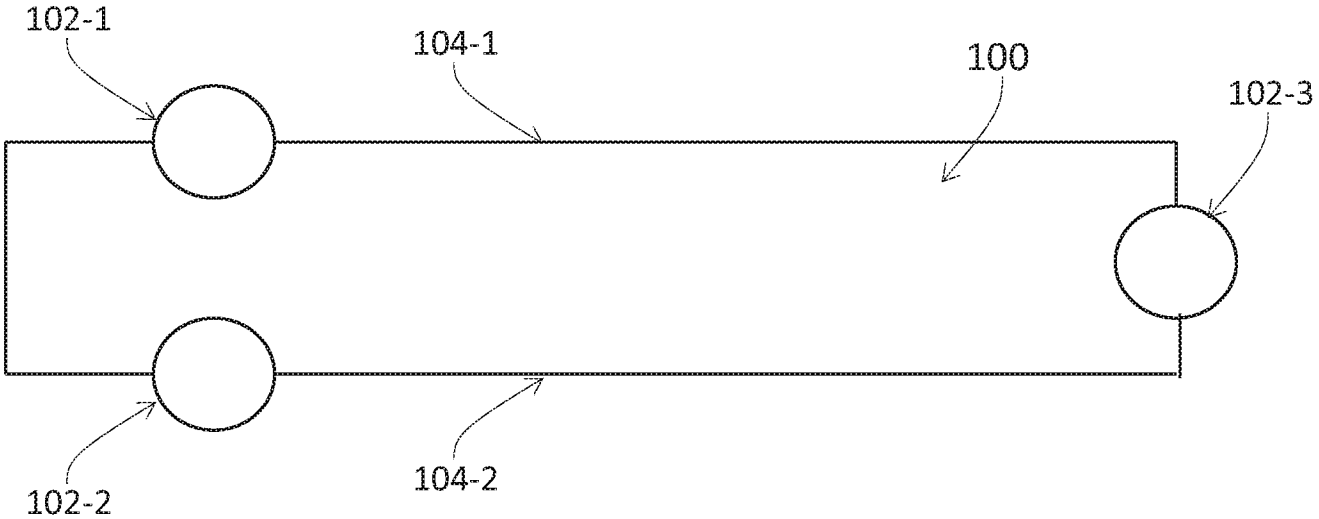
FIG. 1A through FIG. 1C illustrate example computer devices with a plurality of microphones in accordance with example embodiments described herein.

Example embodiments, which relate to multi-microphone signal enhancement, are described herein. In the following description, for the purposes of explanation, numerous specific details are set forth in order to provide a thorough understanding of the example embodiments. It will be apparent, however, that the example embodiments may be practiced without these specific details. In other instances, well-known structures and devices are not described in exhaustive detail, in order to avoid unnecessarily occluding, obscuring, or obfuscating the example embodiments.

Example embodiments are described herein according to the following outline:

1. GENERAL OVERVIEW
2. MULTI-MICROPHONE SIGNAL PROCESSING
3. EXAMPLE MICROPHONE CONFIGURATIONS
4. MULTI-MICROPHONE SIGNAL ENHANCEMENT
5. MULTI-MICROPHONE AUDIO PROCESSOR
6. EXAMPLE PROCESS FLOW
7. IMPLEMENTATION MECHANISMS—HARDWARE OVERVIEW
8. EQUIVALENTS, EXTENSIONS, ALTERNATIVES AND MISCELLANEOUS

1. GENERAL OVERVIEW

This overview presents a basic description of some aspects of the example embodiments described herein. It should be noted that this overview is not an extensive or exhaustive summary of aspects of the example embodiments. Moreover, it should be noted that this overview is not intended to be understood as identifying any particularly significant aspects or elements of the embodiment, nor as delineating any scope of the embodiment in particular, nor in general. This overview merely presents some concepts that relate to the example embodiment in a condensed and simplified format, and should be understood as merely a conceptual prelude to a more detailed description of example embodiments that follows below.

Example embodiments described herein relate to multi-microphone audio processing. A plurality of microphone signals from a plurality of microphones of a computer device is received. Each microphone signal in the plurality of microphone signals is acquired by a respective microphone in the plurality of microphones. A previously unselected microphone is selected from among the plurality of microphones as a reference microphone, which generates a reference microphone signal. An adaptive filter is used to create, based on one or more microphone signals of one or more microphones in the plurality of microphones, one or more predicted microphone signals for the reference microphone. The one or more microphones in the plurality of microphones are other than the reference microphone. Based at least in part on the one or more predicted microphone signals for the reference microphone, an enhanced microphone signal for the reference microphone is outputted. The enhanced microphone signal can be used as microphone signal for the reference microphone in subsequent audio processing operations, e.g. the enhanced microphone signal can be used to replace the reference microphone signal for the reference microphone in subsequent audio processing operations.

In some example embodiments, mechanisms as described herein form a part of a media processing system, including, but not limited to, any of: an audio video receiver, a home theater system, a cinema system, a game machine, a television, a set-top box, a tablet, a mobile device, a laptop computer, netbook computer, desktop computer, computer workstation, computer kiosk, various other kinds of terminals and media processing units, and the like.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

Any of embodiments as described herein may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

2. MULTI-MICROPHONE SIGNAL PROCESSING

Techniques as described herein can be applied to support multi-microphone signal enhancement for microphone layouts with arbitrary positions at which microphone positions may be (e.g., actually, virtually, etc.) located. These techniques can be implemented by a wide variety of computing devices including but not limited to consumer computing devices, end user devices, mobile phones, handsets, tablets, laptops, desktops, wearable computers, display devices, cameras, etc.

Modern computer devices and headphones are equipped with more microphones than ever before. For example, a mobile phone, or a tablet computer (e.g., iPad) with two, three, four or more microphones is quite common. Multiple microphones allow many advanced signal processing methods such as beam forming and noise cancelling to be performed, for example on microphone signals acquired by these microphones. These advanced signal processing methods may linearly combine microphone signals (or original audio signals acquired by the microphones) and create an output audio signal in a single output channel, or output channels that are fewer than the microphones. Under other approaches that do not implement techniques as described herein, spatial information with respect to sound sources is lost, shifted or distorted.

In contrast, techniques as described herein can be used to reduce unwanted signal portions in microphone signals while maintaining inter-microphone relationships in phases and magnitudes. Unlike other approaches that do not implement techniques as described herein, coherent signal portions of the microphone signals are preserved after multi-microphone audio processing as described herein. Any microphone signal of a multi-microphone layout can be paired with any other microphone signal of the multi-microphone layout for the purpose of generating a predicted microphone signal from either microphone in such a pair of microphones to the other microphone in the pair of microphones. Predicted microphone signals, which represent relatively clean and coherent signals while preserving original spatial information captured in the microphone signals, can be used for removing noise content that affect all microphone signals, for removing noise content that affect some of the microphone signals, for other audio processing operations, and the like.

Up to an equal number of enhanced microphone signals can be created based on a number of microphone signals (or original audio signals) acquired by multiple microphones in a microphone layout of a computer device. The enhanced microphone signals have relatively high coherence and relatively highly suppressed noise as compared with the original microphone signals acquired by the microphones, while preserving spatial cues of sound sources that exist in the original microphone signals. In a variety of advanced signal processing methods, the enhanced audio signals with enhanced coherence and preserved spatial cues of sound sources can be used in place of (or in conjunction with) the original microphone signals.

Examples of noise suppressed in enhanced microphone signals as described herein may include, without limitation, microphone capsule noise, wind noise, handling noise, diffuse background sounds, or other incoherent noise.

When sounds such as dialogs, instrument sounds, and the like, that are emitted by or originated from sound sources at nearby locations are acquired by the microphones as audio signal portions of the original microphone signals, high coherence exists in these audio signal portions of the original microphone signals, especially when the microphones are located within a relatively confined spatial volume. Techniques as described herein can be used to ensure that the enhanced microphone signals generated from the original microphone signal preserve the high coherence that exists in the audio signal portions representing the sounds emitted by the nearby sound sources.

3. EXAMPLE MICROPHONE CONFIGURATIONS

Multi-microphone signal enhancement techniques as described herein can be implemented in a wide variety of system configurations of computing devices in which microphones may be disposed spatially at arbitrary positions. By way of examples but not limitation, FIG. 1A through FIG. 1C illustrate example computing devices (e.g., 100, 100-1, 100-2) that include pluralities of microphones (e.g., two microphones, three microphones, four microphones) as system components of the computing devices (e.g., 100, 100-1, 100-2), in accordance with example embodiments as described herein.

Figure 1B:
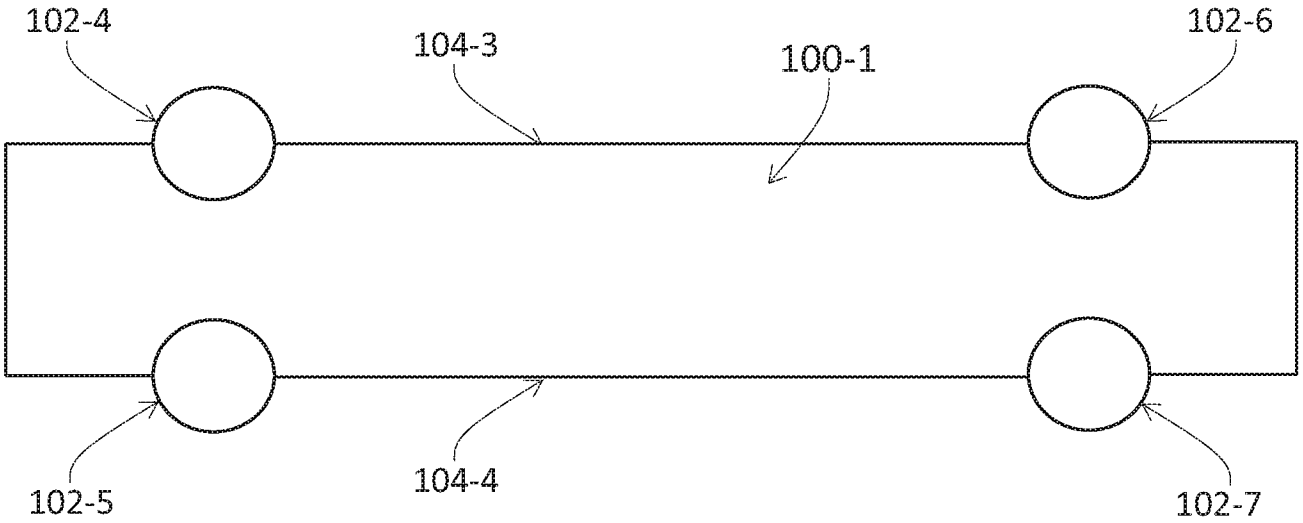
Figure 1C:
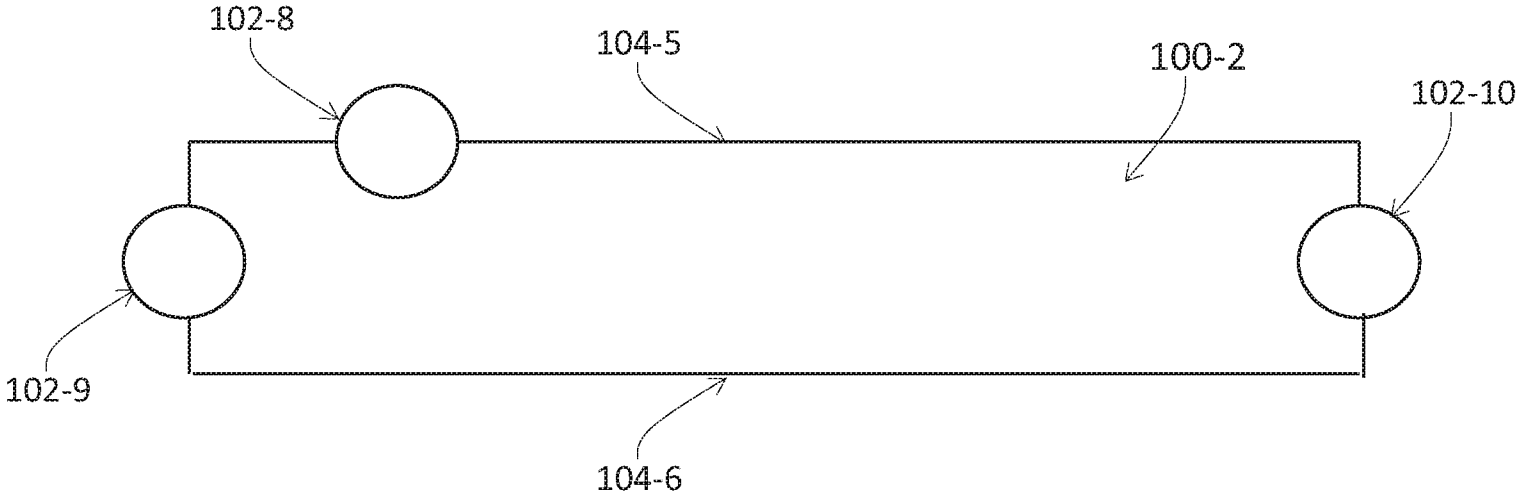

In an example embodiment as illustrated in FIG. 1A, the computing device (100) may have a device physical housing (or a chassis) that includes a first plate 104-1 and a second plate 104-2. The computing device (100) can be manufactured to contain three (built-in) microphones 102-1, 102-2 and 102-3, which are disposed near or inside the device physical housing formed at least in part by the first plate (104-1) and the second plate (104-2).

The microphones (102-1 and 102-2) may be located on a first side (e.g., the left side in FIG. 1A) of the computing device (100), whereas the microphone (102-3) may be located on a second side (e.g., the right side in FIG. 1A) of the computing device (100). In an embodiment, the microphones (102-1, 102-2 and 102-3) of the computing device (100) are disposed in spatial locations that do not represent (or do not resemble) spatial locations corresponding to ear positions of a manikin (or a human). In the example embodiment as illustrated in FIG. 1A, the microphone (102-1) is disposed spatially near or at the first plate (104-1); the microphone (102-2) is disposed spatially near or at the second plate (104-2); the microphone (102-3) is disposed spatially near or at an edge (e.g., on the right side of FIG. 1A) away from where the microphones (102-1 and 102-2) are located.

Examples of microphones as described herein may include, without limitation, omnidirectional microphones, cardioid microphones, boundary microphones, noise-canceling microphones, microphones of different directionality characteristics, microphones based on different physical responses, etc. The microphones (102-1, 102-2 and 102-3) on the computing device (100) may or may not be the same microphone type. The microphones (102-1, 102-2 and 102-3) on the computing device (100) may or may not have the same sensitivity. In an example embodiment, each of the microphones (102-1, 102-2 and 102-3) represents an omnidirectional microphone. In an embodiment, at least two of the microphones (102-1, 102-2 and 102-3) represent two different microphone types, two different directionalities, two different sensitivities, and the like.

In an example embodiment as illustrated in FIG. 1B, the computing device (100-1) may have a device physical housing (or chassis) that includes a third plate 104-3 and a fourth plate 104-4. The computing device (100-1) can be manufactured to contain four (built-in) microphones 102-4, 102-5, 102-6 and 102-7, which are disposed near or inside the device physical housing formed at least in part by the third plate (104-3) and the fourth plate (104-4).

The microphones (102-4 and 102-5) may be located on a first side (e.g., the left side in FIG. 1B) of the computing device (100-1), whereas the microphones (102-6 and 102-7) may be located on a second side (e.g., the right side in FIG. 1B) of the computing device (100-1). In an embodiment, the microphones (102-4, 102-5, 102-6 and 102-7) of the computing device (100-1) are disposed in spatial locations that do not represent (or do not resemble) spatial locations corresponding to ear positions of a manikin (or a human) In the example embodiment as illustrated in FIG. 1B, the microphones (102-4 and 102-6) are disposed spatially in two different spatial locations near or at the third plate (104-3); the microphones (102-5 and 102-7) are disposed spatially in two different spatial locations near or at the fourth plate (104-4).

The microphones (102-4, 102-5, 102-6 and 102-7) on the computing device (100-1) may or may not be the same microphone type. The microphones (102-4, 102-5, 102-6 and 102-7) on the computing device (100-1) may or may not have the same sensitivity. In an example embodiment, the microphones (102-4, 102-5, 102-6 and 102-7) represents omnidirectional microphones. In an example embodiment, at least two of the microphones (102-4, 102-5, 102-6 and 102-7) represents two different microphone types, two different directionalities, two different sensitivities, and the like.

In an example embodiment as illustrated in FIG. 1C, the computing device (100-2) may have a device physical housing that includes a fifth plate 104-5 and a sixth plate 104-6. The computing device (100-2) can be manufactured to contain three (built-in) microphones 102-8, 102-9 and 102-10, which are disposed near or inside the device physical housing formed at least in part by the fifth plate (104-5) and the sixth plate (104-6).

The microphone (102-8) may be located on a first side (e.g., the top side in FIG. 1C) of the computing device (100-2); the microphones (102-9) may be located on a second side (e.g., the left side in FIG. 1C) of the computing device (100-2); the microphones (102-10) may be located on a third side (e.g., the right side in FIG. 1C) of the computing device (100-2). In an embodiment, the microphones (102-8, 102-9 and 102-10) of the computing device (100-2) are disposed in spatial locations that do not represent (or do not resemble) spatial locations corresponding to ear positions of a manikin (or a human). In the example embodiment as illustrated in FIG. 1C, the microphone (102-8) is disposed spatially in a spatial location near or at the fifth plate (104-5); the microphones (102-9 and 102-10) are disposed spatially in two different spatial locations near or at two different interfaces between the fifth plate (104-5) and the sixth plate (104-6), respectively.

The microphones (102-8, 102-9 and 102-10) on the computing device (100-2) may or may not be the same microphone type. The microphones (102-8, 102-9 and 102-10) on the computing device (100-2) may or may not have the same sensitivity. In an example embodiment, the microphones (102-8, 102-9 and 102-10) represents omnidirectional microphones. In an example embodiment, at least two of the microphones (102-8, 102-9 and 102-10) represents two different microphone types, two different directionalities, two different sensitivities, and the like.

4. MULTI-MICROPHONE SIGNAL ENHANCEMENT

Under techniques as described herein, multi-microphone signal enhancement can be performed with microphones (e.g., 102-1, 102-2 and 102-3 of FIG. 1A; 102-4, 102-5, 102-6 and 102-7 of FIG. 1B; 102-8, 102-9 and 102-10 of FIG. 1C) of a computing device (e.g., 100 of FIG. 1A, 100-1 of FIG. 1B, 100-2 of FIG. 1C) in any of a wide variety of microphone layouts.

Given n microphones (n>=2), let m(1), . . . , m(n) represent microphone signals from microphone 1 to microphone n in a computer device. In an embodiment, up to (n−1) predicted microphone signals can be generated for a given microphone among n microphones.

Figure 2A:
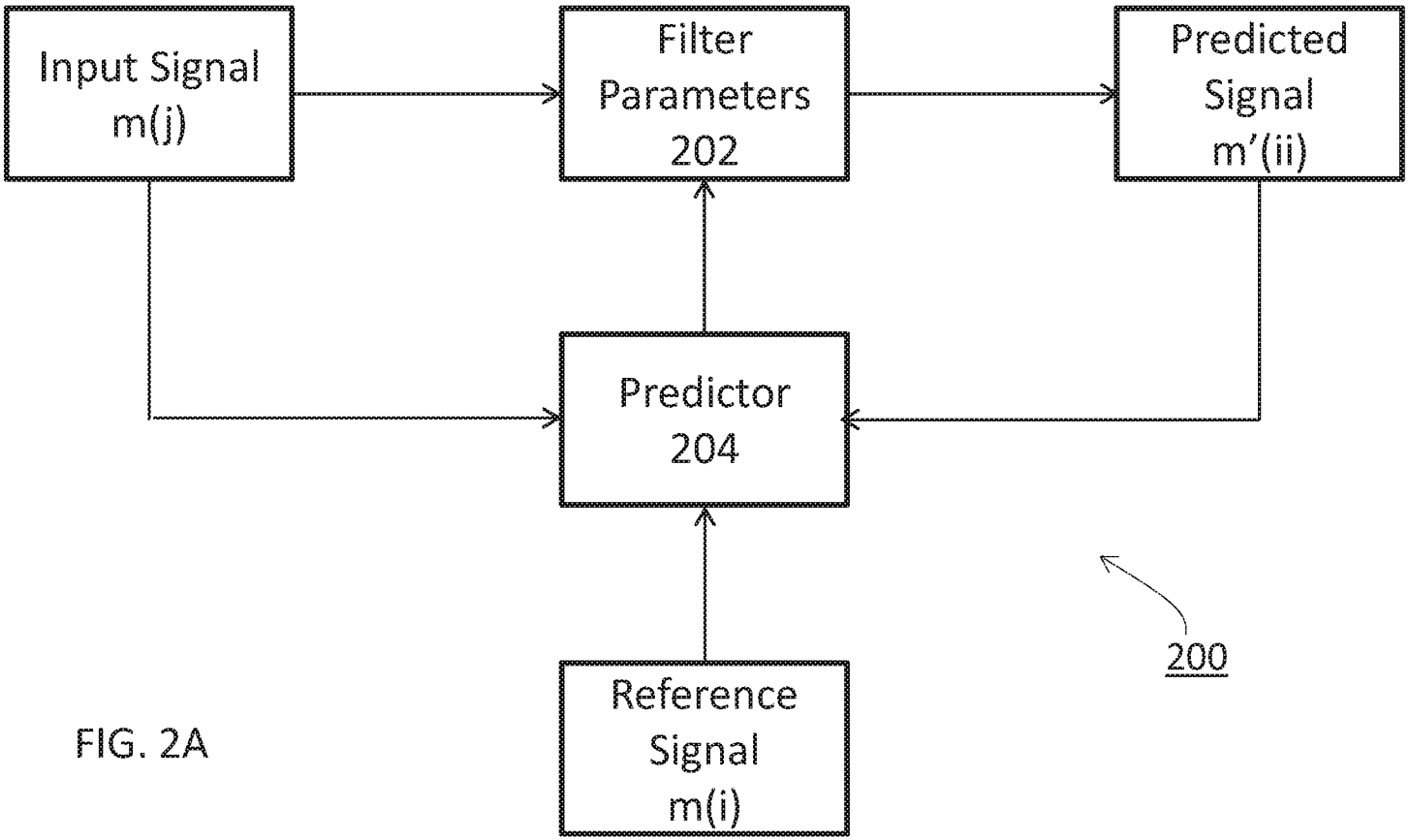
FIG. 2A through FIG. 2C illustrate example generation of predicted microphone signals in accordance with example embodiments described herein.

More specifically, as illustrated in FIG. 2A, for any given microphone i, its microphone signal, m(i), can be used or set as a reference signal in an adaptive filtering framework 200. A microphone signal acquired by another microphone (e.g., microphone j, where j≠i, in the present example)—among microphone 1 to microphone (i−1) and microphone (i+1) to microphone n—can be used as an input signal (denoted as m(j) in the present example) to convolve with filter parameters 202 to create/generate a predicted microphone signal (denoted as m' (ji)) for microphone i. The filter parameters 202 may include, without limitation, filter coefficients and the like.

An estimation or prediction process denoted as predictor 204 may be implemented in the adaptive filtering framework (200) to adaptively determine the filter parameters (202). The adaptive filtering framework (200) refers to a framework in which an input signal is filtered with an adaptive filter whose parameters are adaptively or dynamically determined/updated/adjusted using an optimization algorithm (e.g., minimization of an error function, minimization of a cost function). In various embodiments, one or more in a wide variety of optimization algorithms can be used by adaptive filtering techniques as described herein.

By way of example but not limitation, an optimization algorithm used to (e.g., iteratively, recursively) update filter parameters of an adaptive filter may be a Least-Mean-Squared (LMS) algorithm. In FIG. 2A, such an LMS algorithm may be used to minimize prediction errors between the predicted microphone signal m' (ji), which is a filtered version of the input microphone signal m(j), and the reference signal m(i).

In an embodiment, only correlated signal portions in the input microphone signal m(j) and the reference signal m(i) are (e.g., linearly) modeled in the adaptive filtering framework (200), for example through an adaptive transfer function. The correlated signal portions in the input microphone signal m(j) and the reference signal m(i) may represent transducer responses of microphone i and microphone j to the same sounds originated from the same sound sources/emitters at or near the same location as the microphones. The correlated signal portions in different microphone signals may have specific (e.g., relatively fixed, relatively constant) phase relationships and even magnitude relationships, while un-correlated signal portions (e.g., microphone noise, wind noise) in the different microphone signals do not have such phase (and magnitude) relationships.

The correlated signal portions may represent different directional components, as transduced into the different microphone signals m(i) and m(j) from the same sounds of the same sound sources. In an embodiment, a sound source that generates directional components or coherent signal portions in different microphone signals may be located nearby. Examples of nearby sound sources may include, but are not necessarily limited to only, any of: the user of the computing device, a person in a room or a venue in which the computer device is located, a car driving by a location where the computer device is located, point-sized sound sources, area-sized sound sources, volume-sized sound sources, and the like.

As the difference between the filter version of the input microphone signal m(2) and the reference microphone signal m(1) is minimized by an adaptive filter that operates in conjunction with an adaptive transfer function that (e.g., linearly) models only correlated signal portions, incoherent components such as ambient noise, wind noise, device handling noise, and the like, in the input microphone signal m(2) and/or the reference microphone signal m(1) are attenuated in the predicted microphone signal m'(21), while directional components in the input microphone signal (m(2) that resemble or are correlated with directional components in the reference microphone signal m(1) are preserved in the predicted microphone signal m' (21).

As a result, the predicted microphone signal m'(21) becomes a relatively coherent version of the reference microphone signal m(1), since the predicted microphone signal m'(21) preserves the directional components of the reference microphone signal m(1) but contains relatively little or no incoherent signal portions (or residuals) as compared with the incoherent signal portions that exist in the input microphone signal m(2) and the reference microphone signal m(1).

Figure 2B:
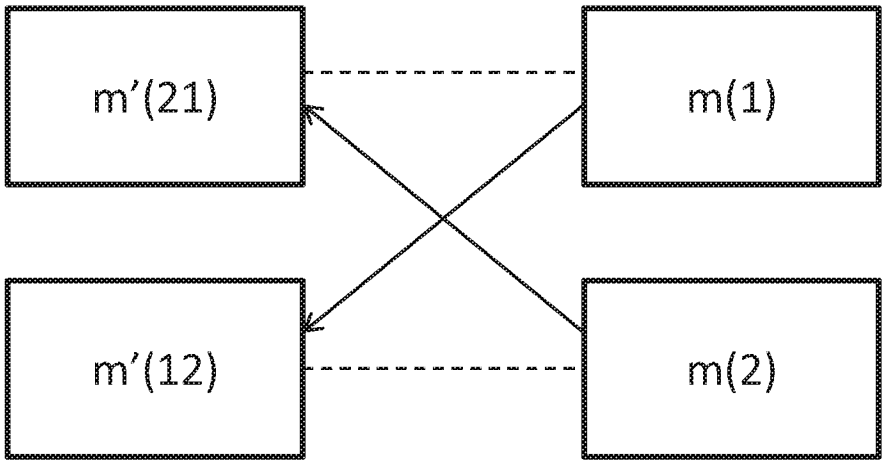

FIG. 2B illustrates example two predicted microphone signals (e.g., m'(21), m'(12)) generated from two microphone signals (e.g., m(1), m(2)). In an embodiment, the two microphone signals (m(1) and m(2)) are respectively generated by two microphones (e.g., microphone 1, microphone 2) in a microphone layout of a computer device.

In an embodiment, the microphone signal m(1) as generated by microphone 1 can be used or selected as a reference signal. The microphone signal m(2) acquired by microphone 2 can be used as an input signal to convolve with an adaptive filter as specified by filter parameters (e.g., 202 of FIG. 2A) adaptively determined by a predictor (e.g., 204 of FIG. 2A) as described herein to create/generate a predicted microphone signal (denoted as m' (21)) for microphone 1. The predictor (204) may adaptively determine the filter parameters of the adaptive filter based on minimizing an error function or a cost function that measures differences between the predicted microphone signal m'(21) and the reference signal m(1).

Similarly, in an embodiment, the microphone signal m(2) as generated by microphone 2 can be used or selected as a reference signal. The microphone signal m(1) acquired by microphone 1 can be used as an input signal to convolve with an adaptive filter as specified with filter parameters (e.g., 202 of FIG. 2A) adaptively determined by a predictor (e.g., 204 of FIG. 2A) as described herein to create/generate a predicted microphone signal (denoted as m' (12)) for microphone 1. The predictor (204) may adaptively determine the filter parameters of the adaptive filter based on minimizing an error function or a cost function that measures differences between the predicted microphone signal m'(12) and the reference signal m(2).

In an embodiment, predicted microphone signal m'(21) may be used as a representative microphone signal, as an enhanced microphone signal, and the like, in place of microphone signal m(1), whereas predicted microphone signal m'(12) may be used as a representative microphone signal, as an enhanced microphone signal, and the like, in place of microphone signal m(2), for example in subsequent audio processing operations.

Additionally, optionally, or alternatively, predicted microphone signal m' (21) may be used in conjunction with microphone signal m(1), whereas predicted microphone signal m'(12) may be used in conjunction with microphone signal m(2), for example in subsequent audio processing operations.

In an embodiment, a (e.g., weighted, unweighted) sum of predicted microphone signal m'(21) and microphone signal m(1) may be used as a representative microphone signal, as an enhanced microphone signal, and the like, in place of microphone signal m(1), whereas a (e.g., weighted, unweighted) sum of predicted microphone signal m' (12) and microphone signal m(2) may be used as a representative microphone signal, as an enhanced microphone signal, and the like, in place of microphone signal m(2), for example in subsequent audio processing operations.

Subsequent audio processing operations may take advantage of characteristics of predicted microphone signals such as relatively high signal coherency, accurate spatial information in terms of time-dependent magnitudes and time-dependent phases for directional components, and the like. Examples of subsequent audio processing operations may include, but are not necessarily limited to only, any of: beam forming operations, binaural audio processing operations, surround audio processing operations, spatial audio processing operations, and the like. Some examples of beam forming operations, binaural audio processing operations, surround audio processing operations, spatial audio processing operations, and the like are described in Provisional U.S. Patent Application No. 62/309,370 filed on 16 Mar. 2016, by CHUNJIAN LI entitled "BINAURAL SOUND CAPTURE FOR MOBILE DEVICES" and assigned to the assignee of the present invention, the contents of which are hereby incorporated herein by reference for all purposes as if fully set forth herein.

Figure 2C:
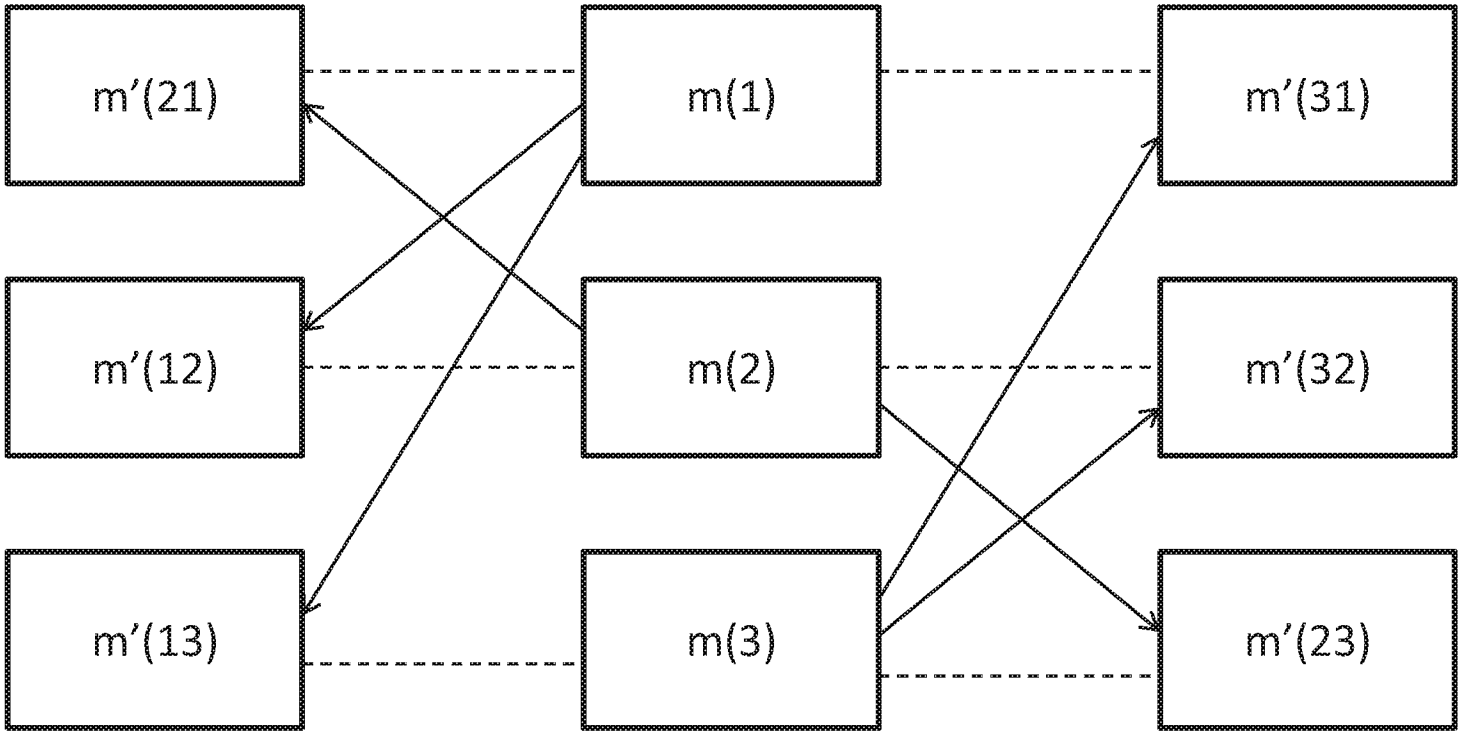

FIG. 2C illustrates example six predicted microphone signals (e.g., m' (21), m' (12), m'(13), m'(31), m'(32), m'(23)) generated from three microphone signals (e.g., m(1), m(2), m(3)). In an embodiment, the three microphone signals (m(1), m(2) and m(3)) are respectively generated by three microphones (e.g., microphone 1, microphone 2, microphone 3) in a microphone layout of a computer device.

Any, some, or all of the six predicted microphone signals (m'(21), m'(12), m'(13), m' (31), m' (32) and m'(23), where the first number in parentheses indicates the index of an input microphone signal and the second number in the parentheses indicates the index of a reference microphone signal) in FIG. 2C, can be generated in a similar manner as how the predicted microphone signals (m'(21), m'(12)) in FIG. 2B are generated through adaptive filtering.

In an embodiment, a predicted microphone signal that corresponds to (or is generated based on a reference microphone signal as represented by) a microphone signal may be used as a representative microphone signal, as an enhanced microphone signal, and the like, in place of the microphone signal, for example in subsequent audio processing operations. In an embodiment, either predicted microphone signal m'(21) or predicted microphone signal m' (31) may be used as a representative microphone signal, as an enhanced microphone signal, and the like, in place of microphone signal m(1). Similarly, in subsequent audio processing operations, either predicted microphone signal m'(12) or predicted microphone signal m'(32) may be used as a representative microphone signal, as an enhanced microphone signal, and the like, in place of microphone signal m(2); either predicted microphone signal m' (23) or predicted microphone signal m'(13) may be used as a representative microphone signal, as an enhanced microphone signal, and the like, in place of microphone signal m(3).

Additionally, optionally, or alternatively, a predicted microphone signal that corresponds to a microphone signal may be used in conjunction with the microphone signal, for example in subsequent audio processing operations. In an embodiment, either predicted microphone signal m'(21) or predicted microphone signal m'(31) or both may be used in conjunction with microphone signal m(1). Similarly, either predicted microphone signal m'(12) or predicted microphone signal m'(32) or both may be used in conjunction with microphone signal m(2); either predicted microphone signal m' (23) or predicted microphone signal m'(13) or both may be used in conjunction with microphone signal m(3).

In an embodiment, a (e.g., weighted, unweighted) sum of two more predicted microphone signals all of which correspond to a microphone signal may be used as a representative microphone signal, as an enhanced microphone signal, and the like, in place of the microphone signal, for example in subsequent audio processing operations. In an embodiment, a (e.g., weighted, unweighted) sum of predicted microphone signal m'(21) and predicted microphone signal m'(31) may be used as a representative microphone signal, as an enhanced microphone signal, and the like, in place of microphone signal m(1). Similarly, in subsequent audio processing operations, a (e.g., weighted, unweighted) sum of predicted microphone signal m'(12) and predicted microphone signal m'(32) may be used as a representative microphone signal, as an enhanced microphone signal, and the like, in place of microphone signal m(2); a (e.g., weighted, unweighted) sum of predicted microphone signal m' (23) and predicted microphone signal m'(13) may be used as a representative microphone signal, as an enhanced microphone signal, and the like, in place of microphone signal m(3).

In an embodiment, a (e.g., weighted, unweighted) sum of a microphone signal and two more predicted microphone signals all of which correspond to the microphone signal may be used as a representative microphone signal, as an enhanced microphone signal, and the like, in place of the microphone signal, for example in subsequent audio processing operations. In an embodiment, a (e.g., weighted, unweighted) sum of microphone signal (1), predicted microphone signal m'(21) and predicted microphone signal m'(31) may be used as a representative microphone signal, as an enhanced microphone signal, and the like, in place of microphone signal m(1). Similarly, a (e.g., weighted, unweighted) sum of microphone signal (2), predicted microphone signal m'(12) and predicted microphone signal m' (32) may be used as a representative microphone signal, as an enhanced microphone signal, and the like, in place of microphone signal m(2); a (e.g., weighted, unweighted) sum of microphone signal (3), predicted microphone signal m' (23) and predicted microphone signal m' (13) may be used as a representative microphone signal, as an enhanced microphone signal, and the like, in place of microphone signal m(3).

Under techniques as described herein, multiple predicted microphone signals can be used to further improve coherency. By way of example but not limitation, both predicted microphone signals m'(21) and m'(31) are linear estimates of coherent components or correlated audio signal portions in microphone signal m(1). However, these predicted microphone signals as estimated in the adaptive filtering framework (200) may still include residuals from incoherent components of input microphone signals m(2) and m(3) and the (reference) microphone signal m(1). By summing up the two predicted microphone signals m'(21) and m'(31) and dividing the sum by two, one can obtain a further reduction of the incoherent components or residuals in the predicted signal m'(21) and m'(31), up to an extra 3 dB reduction of the incoherent components, as the incoherent components do not add up constructively whereas the coherent components do add up constructively. In an embodiment, by repeating this process for all microphones, one can obtain processed predicted microphone signals (e.g., obtained by summing up predicted microphone signals with different incoherent components and dividing the sum by the number of the predicted microphone signals) in which incoherent components are removed or much reduced while the coherent components remain.

In an embodiment, adaptive signal matching as performed in an adaptive filtering framework (e.g., 200 of FIG. 2A) as described herein preserves a phase relationship between a predicted microphone signal and a reference microphone signal. As a result, processed microphone signals obtained from predicted microphone signals as described herein also have relatively intact phase relationships with their respective (reference) microphone signals.

When a sound source emitting sound, the sound from the sound source reaches different microphones of a computer device with different spatial angles and/or different spatial distances. Thus, the sound from the same sound source may arrive at different microphones at small time difference, depending on a spatial configuration of a microphone layout that includes the microphones and spatial relationships between the sound source and the microphones.

For example, a wave front of the sound may reach microphone 1 before the same wave front reaches microphone 2. It may be difficult to use a later acquired microphone signal m(2) generated by microphone 2 to predict an earlier acquired microphone signal m(1), due to non-causality. In an embodiment, because an adaptive filter represents essentially a linear predictor, prediction errors can be large if an input microphone signal to the adaptive filter is later than a reference signal. In an embodiment, a pure delay can be added to the reference signal (which may be, for example, a reference microphone signal m(1) when an input microphone signal m(2) is used for predicting the reference microphone signal m(1)) to prevent non-causality between the input signal (m(2) in the present example) and the reference signal (m(1) in the present example). After adaptive filtering, the pure delay can be removed from the predicted signal (m'(21) in the present example).

Under techniques as described herein, multiple original and predicted microphone signals can be used to reduce noise content. By way of example but not limitation, both predicted microphone signals m'(23) and m'(13) are predicted microphone signal for microphone signal m(3). Microphone signal m(3) may include noise content acquired by microphone 3. Predicted microphone signals m'(23) and m'(13) also may contain residuals from incoherent components of input microphone signals m(2) and m(1) and the (reference) microphone signal m(3). These residuals may represent artifacts from noise content acquired by microphones 1, 2 and 3.

In an embodiment, among some or all of original and predicted microphone signals related to a specific microphone, an audio processor as described herein can select the signal with the lowest instantaneous level as the representative microphone signal for the specific microphone, as wind noise and handling noise often affect only a sub set of the microphones. In an embodiment, an instantaneous level may, but is not necessarily limited to only, represent an audio signal amplitude, where the audio signal amplitude is transduced from a corresponding spatial pressure wave amplitude.

In an embodiment, the audio processor can implement a selector to compare instantaneous levels of some or all of (1) a microphone signal acquired by a specific microphone and (2) predicted microphone signals for the microphone signal, and select an original or predicted microphone signal that has the lowest instantaneous level among the instantaneous levels of the microphone signals as a representative microphone signal for the microphone.

In an embodiment, the audio processor can implement a selector to compare instantaneous levels of some or all of predicted microphone signals for a microphone signal acquired by a specific microphone, and select a predicted microphone signal that has the lowest instantaneous level among the instantaneous levels of the microphone signals as a representative microphone signal (or an enhanced microphone signal) for the microphone.

Additionally, optionally, or alternatively, an audio processor as described herein can generate or derive a representative microphone signal for a specific microphone as a weighted sum of some or all of original and predicted microphone signals related to a specific microphone. A (e.g., scalar, vector, matrix and the like) weight value can be assigned to an original or predicted microphone signal based on one or more audio signal properties of the microphone signal; example audio signal properties include, but are not necessarily limited to only, an instantaneous level of the microphone signal.

5. MULTI-MICROPHONE AUDIO PROCESSOR

Figure 3:
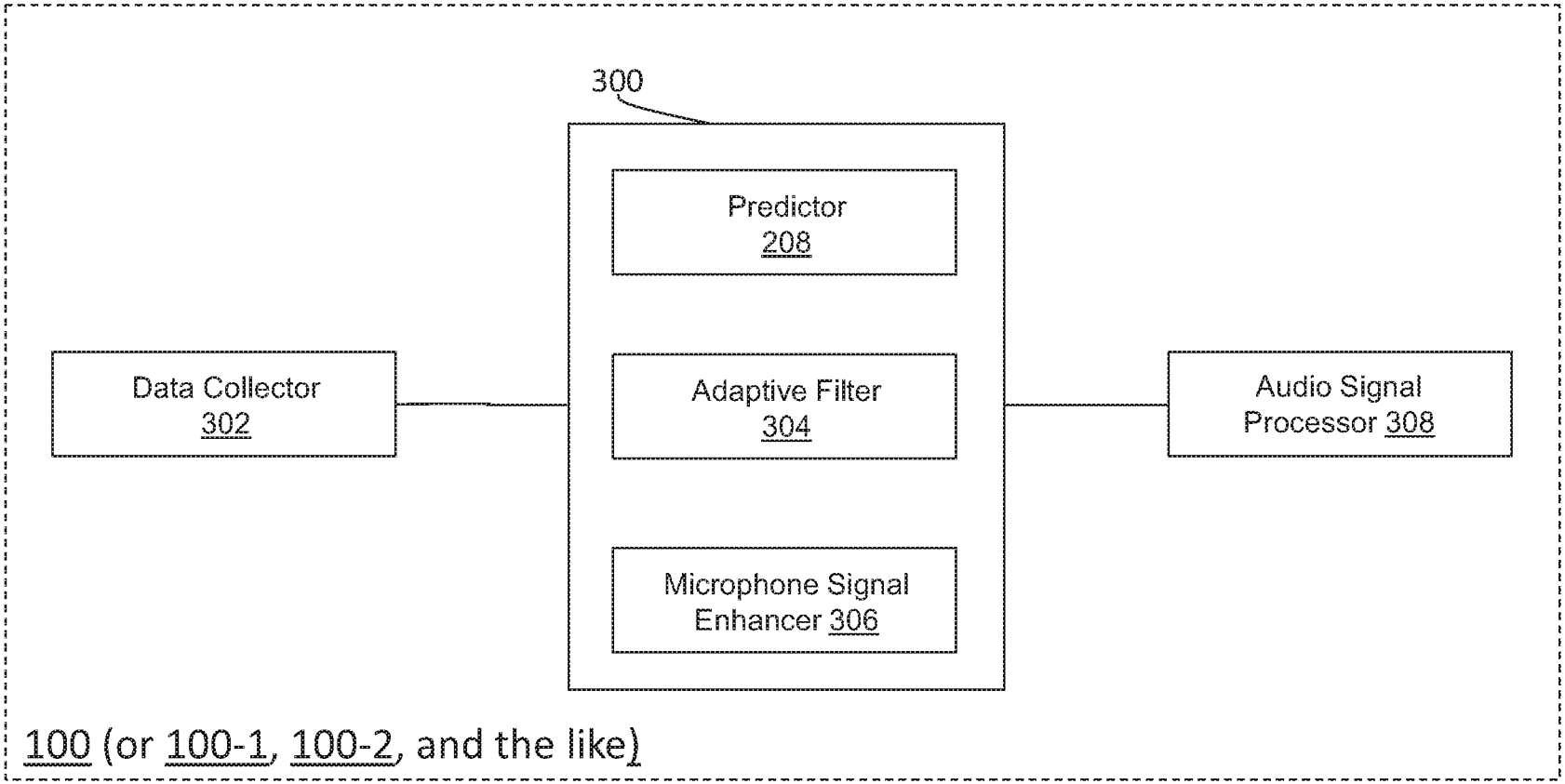
FIG. 3 illustrates an example multi-microphone audio processor in accordance with example embodiments described herein.

FIG. 3 is a block diagram illustrating an example multi-microphone audio processor 300 of a computer device (e.g., 100 of FIG. 1A, 100-1 of FIG. 1B, 100-2 of FIG. 1C, and the like), in accordance with one or more embodiments. In FIG. 3, the multi-microphone audio processor (300) is represented as one or more processing entities collectively configured to receive microphone signals, and the like, from a data collector 302. In an embodiment, some or all of the audio signals are generated by microphones 102-1, 102-2 and 102-3 of FIG. 1A; 102-4, 102-5, 102-6 and 102-7 of FIG. 1B; 102-8, 102-9 and 102-10 of FIG. 1C; and the like.

In an embodiment, the multi-microphone audio processor (300) includes processing entities such as a predictor 204, an adaptive filter 304, a microphone signal enhancer 306, and the like. In an embodiment, the multi-microphone audio processor (300) implements an adaptive filtering framework (e.g., 200 of FIG. 2A) by way of the predictor (204) and the adaptive filter (304).

In an embodiment, the multi-microphone audio processor (300) receives (e.g., original) microphone signals acquired microphones of the computer device, and the like, from the data collector (302). Initially, all of the microphone signals are previously unselected. The multi-microphone audio processor (300) selects or designates a previously unselected microphone from among the microphones as a (current) reference microphone, designates a microphone signal acquired by the reference microphone as a reference microphone signal, designates all of the other microphones as non-reference microphones, and designates microphone signals acquired by some or all of the non-reference microphones as input microphone signals.

In an embodiment, the adaptive filter (304) includes software, hardware, or a combination of software and hardware, configured to create, based on the reference microphone signal and each of the input microphone signals, a predicted microphone signal for the reference microphone. The adaptive filter (304) may be iteratively applied to (via filter convolution) the input microphone signal based on filter parameters (e.g., 202 of FIG. 2A) adaptively determined by the predictor (204). In an embodiment, filter parameters as described herein for successive iterations in applying an adaptive filter to an input microphone signal are time-dependent. The filter parameters may be indexed by respective time values (e.g., time samples, time window values), indexed by a combination of time values and frequency values (e.g., in a linear frequency scale, in a log linear frequency scale, in an equivalent rectangular bandwidth scale), and the like. For example, filter parameters for a current iteration in applying the adaptive filter may be determined based on filter parameters for one or more previous iterations plus any changes/deltas as determined by the predictor (204).

In an embodiment, the predictor (204) includes software, hardware, or a combination of software and hardware, configured to receive the reference microphone signal, the input microphone signal, the predicted microphone signal, and the like, and to iteratively determine optimized filter parameters for each iteration for the adaptive filter (304) to convolve with the input microphone signal. In an embodiment, the predictor (204) may implement an LMS optimization method/algorithm to determine/predict the optimized filter parameters. Additionally, optionally, or alternatively, the optimized filter parameters can be smoothened, for example, using a low-pass filter.

In an embodiment, the reference microphone signal to be predicted from the input microphone signal is inserted with a pure delay for the purpose of maintaining causality between the input microphone signal and the reference microphone signal. This pure delay may be removed from the predicted microphone signal in audio processing operations afterwards. In an embodiment, the pure delay can be set at or larger than the maximum possible propagation delay between the reference microphone and a non-reference microphone that generates the input microphone signal. In an embodiment, the spatial distance (or an estimate thereof) between the reference microphone and the non-reference microphone can be determined beforehand. The spatial distance and the speed of sound in a relevant environment may be used to calculate the maximum possible propagation delay between the reference microphone and the non-reference microphone.

After microphone signals of some or all of the non-reference microphones are used to generate predicted microphone signals for the (current) reference microphone, the multi-microphone audio processor (300) marks the (current) reference microphone as a previously selected microphone, and proceed to select or designate a previously unselected microphone from among the microphones as a new (current) reference microphone, to generate predicted microphone signals for the new reference microphone in the same manner as described herein.

In an embodiment, the microphone signal enhancer (306) includes software, hardware, or a combination of software and hardware, configured to receive some or all of the (e.g., original) microphone signals acquired microphones of the computer device and predicted microphone signals for some or all of the microphones, and to output enhanced microphone signals for some or all of the microphones using one or more of a variety of signal combination and/or selection methods. An enhanced microphone signal, for example, may be a specific predicted microphone signal, a sum of two or more predicted microphone signals, a predicted or original microphone signal of the lowest instantaneous signal level, a sum of an original microphone signal and one or more predicted microphone signals, or a microphone signal generated/determined based at least in part on one or more predicted microphone signal as described herein.

In an embodiment, the audio signal processor (308) includes software, hardware, a combination of software and hardware, etc., configured to receive enhanced microphone signals from the microphone signal enhancer (306). Based on some or all of the data received, the audio signal processor (308) generates one or more output audio signals. These output audio signals can be recorded in one or more tangible recording media, can be delivered/transmitted directly or indirectly to one or more recipient media devices, or can be used to drive audio rendering devices.

Some or all of techniques as described herein can be applied to audio signals (e.g., original microphone signals, predicted microphone signals, a weighted or unweighted sum of microphone signals, an enhanced microphone signal, a representative microphone signal, and the like) in a time domain, or in a transform domain. Additionally, optionally, or alternatively, some or all of these techniques can be applied to audio signals in full bandwidth representations (e.g., a full frequency range supported by an input audio signal as described herein) or in subband representations (e.g., subdivisions of a full frequency range supported by an input audio signal as described herein).

In an embodiment, an analysis filterbank is used to decompose each of one or more original microphone signals acquired by one or more microphones into one or more pluralities of original microphone subband audio data portions (e.g., in a frequency domain). Each of the one or more pluralities of original microphone subband audio data portions corresponds to a plurality of subbands (e.g., in a frequency domain, in a linear frequency scale, in a log linear frequency scale, in an equivalent rectangular bandwidth scale).

An original microphone subband audio data portion for a subband in the plurality of subbands, as decomposed from an original microphone signal of a specific microphone, may be used as a reference microphone subband audio data portion for the subband for the specific microphone. Other original microphone subband audio data portions for the subband may be used as input microphone subband audio data portions for the subband for the specific microphone. These reference microphone subband audio data portion and input microphone subband audio data portions may be adaptively filtered (e.g., as illustrated in FIG. 2A) to generate predicted microphone subband audio data portions for the subband for the specific microphone. Representative microphone subband audio data portions for the subband for the specific microphone can be similarly derived as previously described for representative microphone signals. The foregoing subband audio processing can be repeated for some or all of the plurality of subbands.

In an embodiment, a synthesis filterbank is used to reconstruct subband audio data portions as acquired/processed/generated under techniques as described herein into one or more output audio signals (e.g., representative microphone signals, enhanced microphone signals).

6. EXAMPLE PROCESS FLOW

Figure 4:
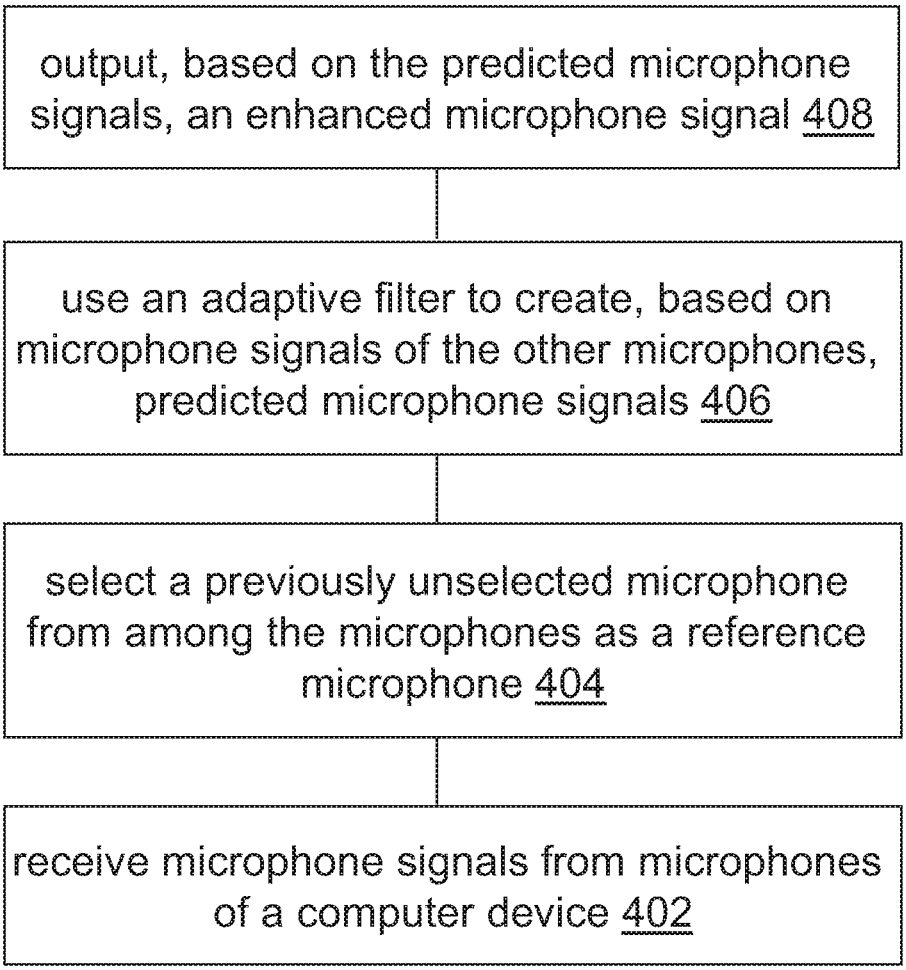
FIG. 4 illustrates an example process flow in accordance with example embodiments described herein.

FIG. 4 illustrates an example process flow suitable for describing the example embodiments described herein. In some embodiments, one or more computing devices or units (e.g., a computer device as described herein, a multi-microphone audio processor of a computer device as described herein, etc.) may perform the process flow.

In block 402, a computer device receives a plurality of microphone signals from a plurality of microphones of a computer device, each microphone signal in the plurality of microphone signals being acquired by a respective microphone in the plurality of microphones.

In block 404, the computer device selects a previously unselected microphone from among the plurality of microphones as a reference microphone, a reference microphone signal being generated by the reference microphone.

In block 406, the computer device uses an adaptive filter to create, based on one or more microphone signals of one or more microphones in the plurality of microphones, one or more predicted microphone signals for the reference microphone, the one or more microphones in the plurality of microphones being other than the reference microphone.

In block 408, the computer device outputs, based at least in part on the one or more predicted microphone signals for the reference microphone, an enhanced microphone signal for the reference microphone, the enhanced microphone signal being used as microphone signal for the reference microphone in subsequent audio processing operations. For example, the enhanced microphone signal is used to replace the reference microphone signal for the reference microphone in subsequent audio processing operations.

In an embodiment, the computer device is configured to repeat operations in block 404 through 408 for each microphone in the plurality of microphones.

In an embodiment, filter parameters of the adaptive filter are updated based on an optimization method. In an embodiment, the optimization method represents a least mean squared (LMS) optimization method. In an embodiment, the optimization method minimizes differences between the reference microphone signal of the reference microphone and each of the one or more microphone signals of the one or more microphones other than the reference microphone.

In an embodiment, the adaptive filter is configured to preserve correlated audio data portions, in the reference microphone signal of the reference microphone and each of the one or more microphone signals of the one or more microphones other than the reference microphone.

In an embodiment, the adaptive filter is configured to reduce uncorrelated audio data portions in the reference microphone signal of the reference microphone and each of the one or more microphone signals of the one or more microphones other than the reference microphone.

In an embodiment, each of the one or more microphone signals of the one or more microphones other than the reference microphone is used by the adaptive filter as an input microphone signal for generating a corresponding predicted microphone signal in the one or more predicted microphone signals.

In an embodiment, the subsequent audio processing operations includes one or more of: beam forming operations, binaural audio processing operations, surround audio processing operations, spatial audio processing operations, audio processing operations that are performed based on original spatial information of the microphone signals as preserved in the one or more predicted microphone signals, and the like.

In an embodiment, the enhanced microphone signal is selected from the one or more predicted microphone signals based on one or more selection criteria.

In an embodiment, the enhanced microphone signal represents a sum of the one or more predicted microphone signals.

In an embodiment, the enhanced microphone signal is selected from the reference microphone signal and the one or more predicted microphones, based on one or more selection criteria. In an embodiment, the on one or more selection criteria including a criterion related to instantaneous signal level.

In an embodiment, the enhanced microphone signal represents a sum of the reference microphone signal and the one or more predicted microphone signals.

In an embodiment, each of the one or more predicted microphone signals is generated by removing a pure delay from a predicted signal that is created based on the reference microphone signal with the pure delay inserted into the reference microphone signal. For example, the method comprises adding a pure delay to the reference signal prior to using the adaptive filter, creating the one or more predicted microphone signals for the reference microphone using the adaptive filter, and, after using the adaptive filter, removing the pure delay from the one or more predicted signals.

In an embodiment, each microphone in the plurality of microphones is an omnidirectional microphone.

In an embodiment, at least one microphone in the plurality of microphones is a directional microphone.

Embodiments include, a media processing system configured to perform any one of the methods as described herein.

Embodiments include an apparatus including a processor and configured to perform any one of the foregoing methods.

Embodiments include a non-transitory computer readable storage medium, storing software instructions, which when executed by one or more processors cause performance of any one of the foregoing methods. Note that, although separate embodiments are discussed herein, any combination of embodiments and/or partial embodiments discussed herein may be combined to form further embodiments.

7. IMPLEMENTATION MECHANISMS—HARDWARE OVERVIEW

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 5:
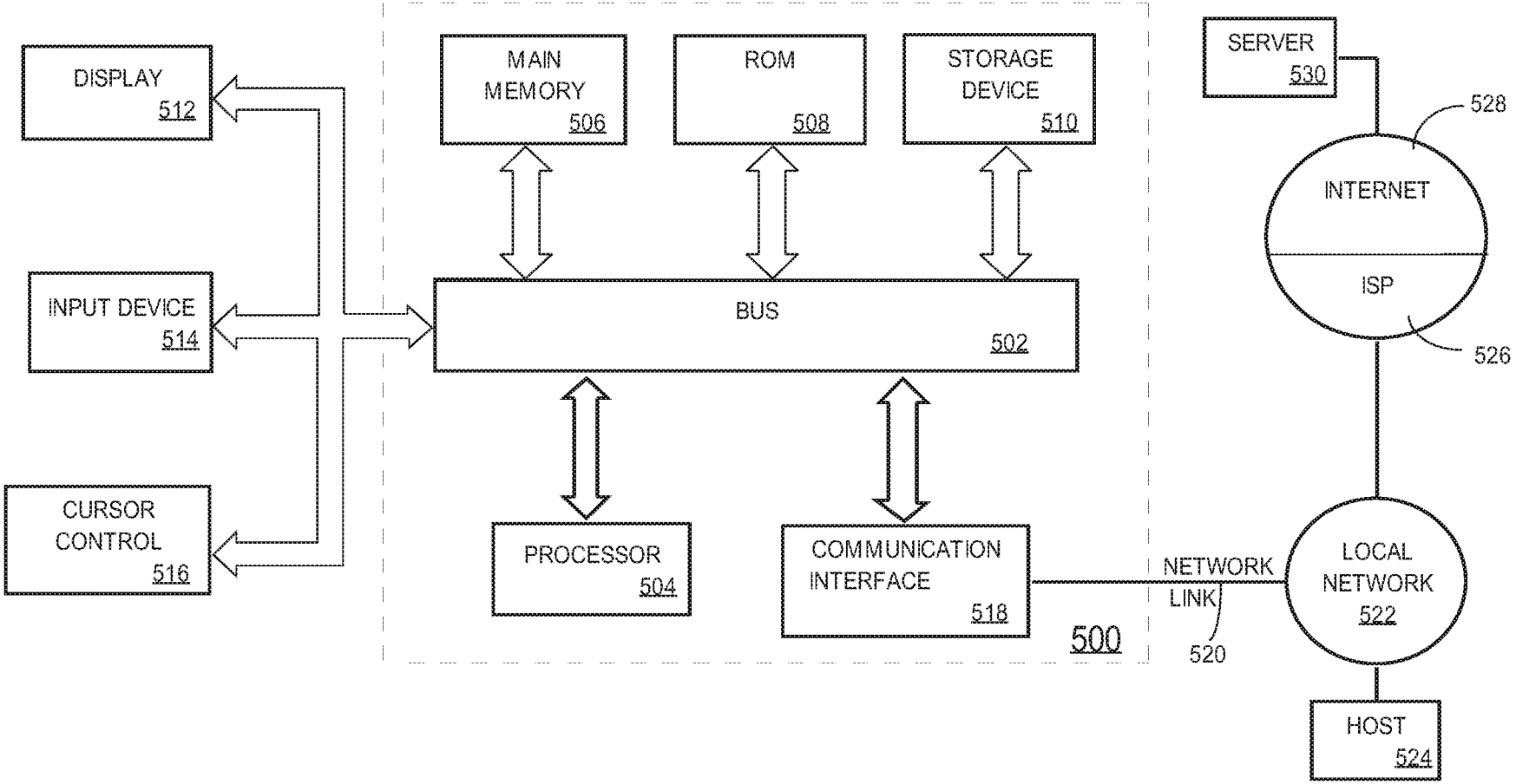
FIG. 5 illustrates an example hardware platform on which a computer or a computing device as described herein may be implement the example embodiments described herein.

For example, FIG. 5 is a block diagram that illustrates a computer system 500 upon which an embodiment of the invention may be implemented. Computer system 500 includes a bus 502 or other communication mechanism for communicating information, and a hardware processor 504 coupled with bus 502 for processing information. Hardware processor 504 may be, for example, a general purpose microprocessor.

Computer system 500 also includes a main memory 506, such as a random access memory (RAM) or other dynamic storage device, coupled to bus 502 for storing information and instructions to be executed by processor 504. Main memory 506 also may be used for storing temporary variables or other intermediate information during execution of instructions to be executed by processor 504. Such instructions, when stored in non-transitory storage media accessible to processor 504, render computer system 500 into a special-purpose machine that is device-specific to perform the operations specified in the instructions.

Computer system 500 further includes a read only memory (ROM) 508 or other static storage device coupled to bus 502 for storing static information and instructions for processor 504. A storage device 510, such as a magnetic disk or optical disk, is provided and coupled to bus 502 for storing information and instructions.

Computer system 500 may be coupled via bus 502 to a display 512, such as a liquid crystal display (LCD), for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. This input device typically has two degrees of freedom in two axes, a first axis (e.g., x) and a second axis (e.g., y), that allows the device to specify positions in a plane.

Computer system 500 may implement the techniques described herein using device-specific hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor 504 executing one or more sequences of one or more instructions contained in main memory 506. Such instructions may be read into main memory 506 from another storage medium, such as storage device 510. Execution of the sequences of instructions contained in main memory 506 causes processor 504 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may include non-volatile media and/or volatile media. Non-volatile media includes, for example, optical or magnetic disks, such as storage device 510. Volatile media includes dynamic memory, such as main memory 506. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that include bus 502. Transmission media can also take the form of acoustic or light waves, such as those generated during radio-wave and infra-red data communications.

Various forms of media may be involved in carrying one or more sequences of one or more instructions to processor 504 for execution. For example, the instructions may initially be carried on a magnetic disk or solid state drive of a remote computer. The remote computer can load the instructions into its dynamic memory and send the instructions over a telephone line using a modem. A modem local to computer system 500 can receive the data on the telephone line and use an infra-red transmitter to convert the data to an infra-red signal. An infra-red detector can receive the data carried in the infra-red signal and appropriate circuitry can place the data on bus 502. Bus 502 carries the data to main memory 506, from which processor 504 retrieves and executes the instructions. The instructions received by main memory 506 may optionally be stored on storage device 510 either before or after execution by processor 504.

Computer system 500 also includes a communication interface 518 coupled to bus 502. Communication interface 518 provides a two-way data communication coupling to a network link 520 that is connected to a local network 522. For example, communication interface 518 may be an integrated services digital network (ISDN) card, cable modem, satellite modem, or a modem to provide a data communication connection to a corresponding type of telephone line. As another example, communication interface 518 may be a local area network (LAN) card to provide a data communication connection to a compatible LAN. Wireless links may also be implemented. In any such implementation, communication interface 518 sends and receives electrical, electromagnetic or optical signals that carry digital data streams representing various types of information.

Network link 520 typically provides data communication through one or more networks to other data devices. For example, network link 520 may provide a connection through local network 522 to a host computer 524 or to data equipment operated by an Internet Service Provider (ISP) 526. ISP 526 in turn provides data communication services through the world wide packet data communication network now commonly referred to as the "Internet" 528. Local network 522 and Internet 528 both use electrical, electromagnetic or optical signals that carry digital data streams. The signals through the various networks and the signals on network link 520 and through communication interface 518, which carry the digital data to and from computer system 500, are example forms of transmission media.

Computer system 500 can send messages and receive data, including program code, through the network(s), network link 520 and communication interface 518. In the Internet example, a server 530 might transmit a requested code for an application program through Internet 528, ISP 526, local network 522 and communication interface 518.

The received code may be executed by processor 504 as it is received, and/or stored in storage device 510, or other non-volatile storage for later execution.

8. EQUIVALENTS, EXTENSIONS, ALTERNATIVES AND MISCELLANEOUS

In the foregoing specification, example embodiments have been described with reference to numerous specific details that may vary from implementation to implementation. Any definitions expressly set forth herein for terms contained in the claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

Various modifications and adaptations to the foregoing example embodiments may become apparent to those skilled in the relevant arts in view of the foregoing description, when it is read in conjunction with the accompanying drawings. Any and all modifications will still fall within the scope of the non-limiting and example embodiments. Furthermore, other example embodiment category forth herein will come to mind to one skilled in the art to which these embodiments pertain having the benefit of the teachings presented in the foregoing descriptions and the drawings.

Accordingly, the present invention may be embodied in any of the forms described herein. For example, the following enumerated example embodiments (EEEs) describe some structures, features, and functionalities of some aspects of the present invention.

EEE 1. A computer-implemented method, comprising: (a) receiving a plurality of microphone signals from a plurality of microphones of a computer device, each microphone signal in the plurality of microphone signals being acquired by a respective microphone in the plurality of microphones; (b) selecting a previously unselected microphone from among the plurality of microphones as a reference microphone, a reference microphone signal being generated by the reference microphone; (c) using an adaptive filter to create, based on one or more microphone signals of one or more microphones in the plurality of microphones, one or more predicted microphone signals for the reference microphone, the one or more microphones in the plurality of microphones being other than the reference microphone; (d) outputting, based at least in part on the one or more predicted microphone signals for the reference microphone, an enhanced microphone signal for the reference microphone, the enhanced microphone signal being used as microphone signal for the reference microphone in subsequent audio processing operations.

EEE 2. The method as recited in EEE 1, further comprising repeating (b) through (d) for each microphone in the plurality of microphones EEE 3. The method as recited in EEE 1 or EEE 2, wherein filter parameters of the adaptive filter are updated based on an optimization method.

EEE 4. The method as recited in EEE 3, wherein the optimization method represents a least mean squared (LMS) optimization method.

EEE 5. The method as recited in EEE 3 or EEE 4, wherein the optimization method minimizes differences between the reference microphone signal of the reference microphone and each of the one or more microphone signals of the one or more microphones other than the reference microphone.

EEE 6. The method as recited in any of EEEs 1-5, wherein the adaptive filter is configured to preserve correlated audio data portions, in the reference microphone signal of the reference microphone and each of the one or more microphone signals of the one or more microphones other than the reference microphone.

EEE 7. The method as recited in any of EEEs 1-6, wherein the adaptive filter is configured to reduce uncorrelated audio data portions in the reference microphone signal of the reference microphone and each of the one or more microphone signals of the one or more microphones other than the reference microphone.

EEE 8. The method as recited in any of EEEs 1-7, wherein each of the one or more microphone signals of the one or more microphones other than the reference microphone is used by the adaptive filter as an input microphone signal for generating a corresponding predicted microphone signal in the one or more predicted microphone signals.

EEE 9. The method as recited in any of EEEs 1-8, wherein the subsequent audio processing operations comprises one or more of: beam forming operations, binaural audio processing operations, surround audio processing operations, spatial audio processing operations, or audio processing operations that are performed based on original spatial information of the microphone signals as preserved in the one or more predicted microphone signals.

EEE 10. The method as recited in any of EEEs 1-9, wherein the enhanced microphone signal is selected from the one or more predicted microphone signals based on one or more selection criteria.

EEE 11. The method as recited in any of EEEs 1-10, wherein the enhanced microphone signal represents a sum of the one or more predicted microphone signals.

EEE 12. The method as recited in any of EEEs 1-11, wherein the enhanced microphone signal is selected from the reference microphone signal and the one or more predicted microphones, based on one or more selection criteria.

EEE 13. The method as recited in EEE 12, wherein the on one or more selection criteria including a criterion related to instantaneous signal level.

EEE 14. The method as recited in any of EEEs 1-13, wherein the enhanced microphone signal represents a sum of the reference microphone signal and the one or more predicted microphone signals.

EEE 15. The method as recited in any of EEEs 1-14, the method comprising: adding a pure delay to the reference signal prior to using the adaptive filter, creating the one or more predicted microphone signals for the reference microphone using the adaptive filter, and, removing the pure delay from the one or more predicted signals after using the adaptive filter.

EEE 16. The method as recited in any of EEEs 1-15, wherein each microphone in the plurality of microphones is an omnidirectional microphone.

EEE 17. The method as recited in any of EEEs 1-16, wherein at least one microphone in the plurality of microphones is a directional microphone.

EEE 18. A media processing system configured to perform any one of the methods recited in EEEs 1-17.

EEE 19. An apparatus comprising a processor and configured to perform any one of the methods recited in EEEs 1-17.

EEE 20. A non-transitory computer readable storage medium, storing software instructions, which when executed by one or more processors cause performance of any one of the methods recited in EEEs 1-17.

It will be appreciated that the embodiments of the invention are not to be limited to the specific embodiments disclosed and that modifications and other embodiments are intended to be included within the scope of the appended claims. Although specific terms are used herein, they are used in a generic and descriptive sense only, and not for purposes of limitation.

The invention claimed is:

1. A computer-implemented method, comprising:

(a) receiving a plurality of microphone signals from a plurality of microphones of a computer device, each microphone signal in the plurality of microphone signals being acquired by a respective microphone in the plurality of microphones;

(b) selecting a previously unselected microphone from among the plurality of microphones as a reference microphone, a reference microphone signal being generated by the reference microphone;

(c) using an adaptive filter to create, based on one or more microphone signals of one or more microphones in the plurality of microphones, one or more predicted microphone signals for the reference microphone, the one or more microphones in the plurality of microphones being other than the reference microphone;

(d) outputting, based at least in part on the one or more predicted microphone signals for the reference microphone, an enhanced microphone signal for the reference microphone, the enhanced microphone signal being used to replace the reference microphone signal for the reference microphone in subsequent audio processing operations.

2. The method as recited in claim 1, further comprising repeating (b) through (d) for each microphone in the plurality of microphones.

3. The method as recited in claim 1, wherein filter parameters of the adaptive filter are updated based on an optimization method.

4. The method as recited in claim 3, wherein the optimization method represents a least mean squared (LMS) optimization method.

5. The method as recited in claim 3, wherein the optimization method minimizes differences between the reference microphone signal of the reference microphone and each of the one or more microphone signals of the one or more microphones other than the reference microphone.

6. The method as recited in claim 1, wherein the adaptive filter is configured to preserve correlated audio data portions, in the reference microphone signal of the reference microphone and each of the one or more microphone signals of the one or more microphones other than the reference microphone.

7. The method as recited in claim 1, wherein the adaptive filter is configured to reduce uncorrelated audio data portions in the reference microphone signal of the reference microphone and each of the one or more microphone signals of the one or more microphones other than the reference microphone.

8. The method as recited in claim 1, wherein each of the one or more microphone signals of the one or more microphones other than the reference microphone is used by the adaptive filter as an input microphone signal for generating a corresponding predicted microphone signal in the one or more predicted microphone signals.

9. The method as recited in claim 1, wherein the subsequent audio processing operations comprises one or more of: beam forming operations, binaural audio processing operations, surround audio processing operations, spatial audio processing operations, or audio processing operations that are performed based on original spatial information of the microphone signals as preserved in the one or more predicted microphone signals.

10. The method as recited in claim 1, wherein the enhanced microphone signal is selected from the one or more predicted microphone signals based on one or more selection criteria.

11. The method as recited in claim 1, wherein the enhanced microphone signal represents a sum of the one or more predicted microphone signals.

12. The method as recited in claim 1, wherein the enhanced microphone signal is selected from the reference microphone signal and the one or more predicted microphones, based on one or more selection criteria, and optionally wherein the on one or more selection criteria including a criterion related to instantaneous signal level.

13. The method as recited in claim 1, wherein the enhanced microphone signal represents a sum of the reference microphone signal and the one or more predicted microphone signals.

14. The method as recited in claim 1, wherein each of the one or more predicted microphone signals is generated by removing a pure delay from a predicted signal that is created based on the reference microphone signal with the pure delay inserted into the reference microphone signal.

15. The method as recited in claim 1, wherein each microphone in the plurality of microphones is an omnidirectional microphone, and optionally wherein at least one microphone in the plurality of microphones is a directional microphone.

* * * * *